US006084940A

United States Patent [19]

Van Asten

[11] Patent Number: 6,084,940

[45] Date of Patent: Jul. 4, 2000

[54] EXPOSURE CONTROL ON THE BASIS OF A RELEVANT PART OF AN X-RAY IMAGE

[75] Inventor: Aldegonda C. M. Van Asten, Eindhoven, Netherlands

[73] Assignee: U.S. Philips Corporation, New York, N.Y.

[21] Appl. No.: 09/061,811

[22] Filed: Apr. 16, 1998

[30] Foreign Application Priority Data

Apr. 24, 1997 [EP] European Pat. Off. ..... 97201223

[51] Int. Cl.[7] ..... H05G 1/64

[52] U.S. Cl. ..... 378/98.7; 378/97; 378/98.8; 378/108

[58] Field of Search ..... 378/98.7, 98.8, 378/97, 108

[56] References Cited

U.S. PATENT DOCUMENTS

| | | | |
|---|---|---|---|
| 4,907,156 | 3/1990 | Doi et al. | 382/132 |
| 4,982,418 | 1/1991 | Kuehnel | 378/98.7 |
| 5,012,504 | 4/1991 | McFaul et al. | 378/108 |
| 5,132,541 | 7/1992 | Conrads et al. | 250/370.01 |
| 5,194,736 | 3/1993 | Meulenbrugge et al. | 250/370.07 |
| 5,396,072 | 3/1995 | Schiebel et al. | 250/370.09 |
| 5,448,613 | 9/1995 | Haendle et al. | 378/98.7 |
| 5,461,658 | 10/1995 | Joosten | 978/98.7 |
| 5,530,238 | 6/1996 | Meulenbrugge et al. | 250/208.1 |
| 5,572,257 | 11/1996 | Conrads | 348/308 |
| 5,574,764 | 11/1996 | Granfors et al. | 378/98.7 |
| 5,710,801 | 1/1998 | Dillen et al. | 378/98.7 |
| 5,729,021 | 3/1998 | Brauers et al. | 250/370.09 |
| 5,751,783 | 5/1998 | Granfors et al. | 378/108 |
| 5,974,166 | 10/1999 | Ino et al. | 382/132 |
| 5,978,443 | 11/1999 | Patel | 378/62 |

OTHER PUBLICATIONS

Concise guide Systems and Components, The BV300 Series, Mobile C–Arm Systems for Universal and Advanced Applications, Philips Medical Systems International B.V. 1997.

*Primary Examiner*—David P. Porta
*Assistant Examiner*—Allen C. Ho
*Attorney, Agent, or Firm*—Dwight H. Renfrew, Jr.

[57] ABSTRACT

An X-ray examination apparatus according to the present invention includes an X-ray detector for deriving an image signal from an X-ray image, and an exposure control system for adjustment of the X-ray examination apparatus on the basis of a relevant part of the X-ray image. The exposure control system is arranged to group pixels of the X-ray image in one or more clusters on the basis of their brightness values and to select the relevant part of the X-ray image from the clusters.

15 Claims, 1 Drawing Sheet

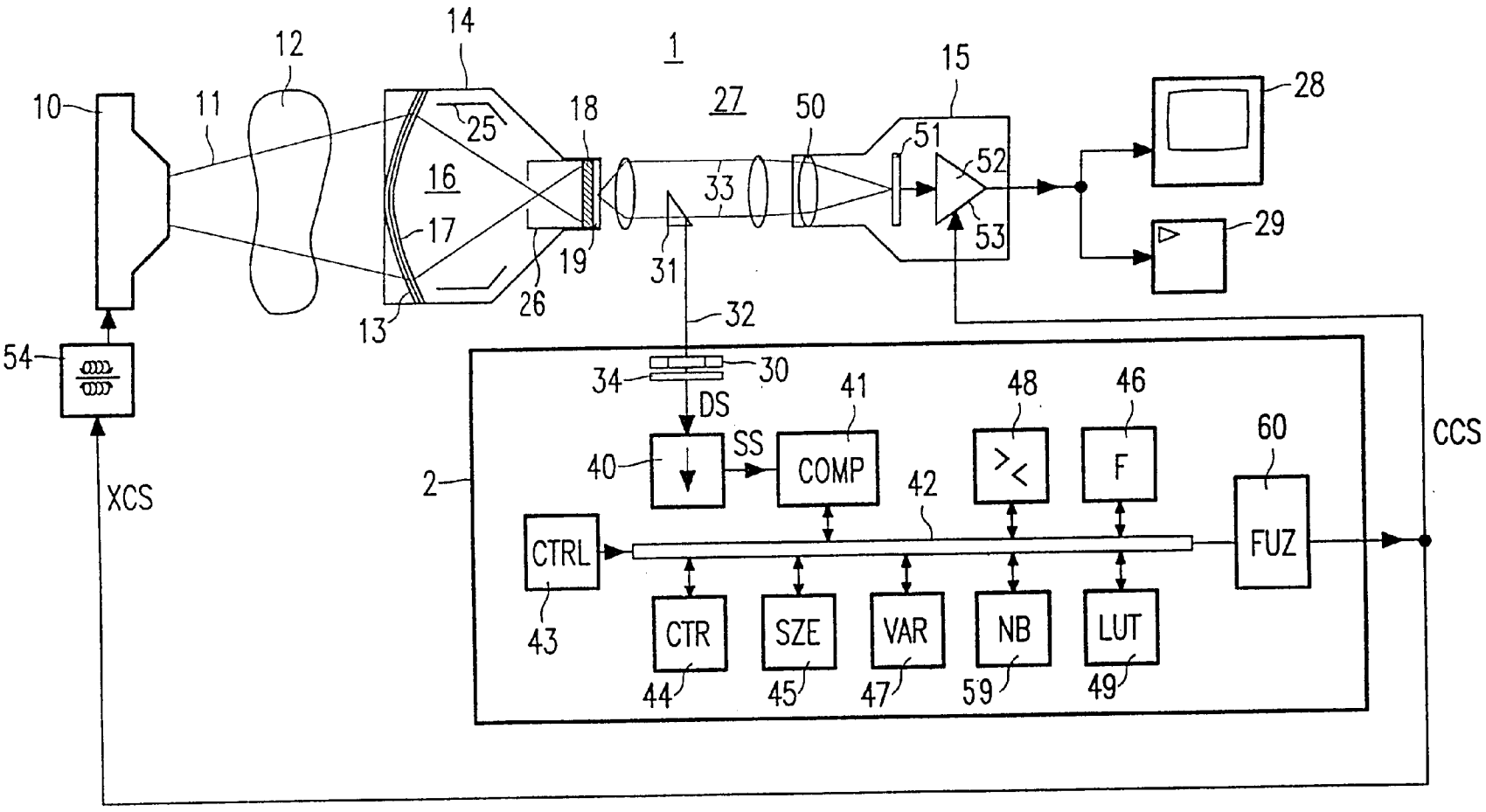
CCS
28
29
60
FUZ
46
F
LUT
49
48
>
NB
59
15
52
53
51
42
VAR
47
41
COMP
50
SZE
45
27
33
30
32
SS
DS
1
31
CTR
44
34
40
18
19
CTRL
43
26
14
25
16
17
2
13
12
11
XCS
10
54

EXPOSURE CONTROL ON THE BASIS OF A RELEVANT PART OF AN X-RAY IMAGE

BACKGROUND OF THE INVENTION

1. Field of the Invention

The invention relates to an X-ray examination apparatus which includes an X-ray detector for receiving an X-ray image and an exposure control system for adjustment of the X-ray examination apparatus on the basis of a relevant part of the X-ray image. The invention also relates to an X-ray examination apparatus provided with an X-ray detector for deriving an optical image from an X-ray image and an exposure control system for adjustment of the X-ray examination apparatus on the basis of a relevant part of the optical image. The invention also pertains to a method of adjusting an x-ray apparatus.

2. Description of Related Art

An X-ray examination apparatus of this kind is known from U.S. Pat. No. 5,461,658.

The X-ray examination apparatus includes an X-ray source for irradiating an object to be examined, for example a patient to be radiologically examined, by means of an X-ray beam. Due to local differences in the X-ray absorptivity within the patient, an X-ray image is formed on an X-ray-sensitive surface of the X-ray detector. The X-ray detector derives an image signal from the X-ray image. The image signal is, for example an electronic video signal whose signal levels represent brightness values of the X-ray image. The known X-ray examination apparatus includes an X-ray image intensifier for deriving an optical image from the X-ray image. The known X-ray examination apparatus also includes a television camera for deriving the electronic video signal from the optical image. The X-ray image has a large dynamic range, being the interval comprising the brightness values of the X-ray image. However, relevant image information in the X-ray image is comprised in a small range within the much larger range of brightness values of the entire X-ray image. If no steps were taken, the range of the values of the signal level of the image signal would not be suitable for suitably visible reproduction of the image information in the X-ray image. Particularly the dynamic range of brightness values of the X-ray image, and hence of the optical image, would be much too large for the further processing of the image signal.

The known X-ray examination apparatus includes an auxiliary light detection system which acts as an exposure control system. The auxiliary light detection system includes a CCD sensor for locally measuring the brightness in the optical image. The exposure control system derives a control signal from the measured brightness values, said control signal being used to adjust the X-ray apparatus in such a manner that an X-ray image of high diagnostic quality is formed and displayed, i.e. that small details are included in the X-ray image and suitably visibly reproduced. The auxiliary light detection system adjusts the X-ray examination apparatus in such a manner that signal levels of the image signals have values which are suitable for reproducing an image of high diagnostic quality. The control signal controls the intensity and/or the energy of the X-ray beam. The control signal can also be used to control the amplification of the image signal. Both steps influence the signal level of the image signal directly or indirectly.

The auxiliary light detection system of the known X-ray examination apparatus utilizes local brightness values in the optical image in order to adjust, for example the X-ray source, but it does not always take into account the fact that overexposed areas of high brightness occur in the optical image. Such overexposed areas are caused, for example by X-rays which are not or only hardly attenuated by the object to be examined, for example a patient. In that case X-rays are involved which have not passed through the patient or have traversed tissue having a low X-ray absorptivity, for example lung tissue. Such overexposed areas contain hardly any or even no image information, but could have an adverse effect on the adjustment of the known X-ray examination apparatus. The auxiliary light detection system of the known X-ray apparatus also does not take into account the fact that dark areas of low brightness which do not contain relevant image information either may also occur in the X-ray image. For example, X-ray absorbing elements such as collimator elements or filter elements are reproduced as such dark areas in the X-ray image. It has been found that the overexposed areas and dark areas, both of which do not contain any or hardly any relevant image information, can have an adverse effect on the adjustment of the known X-ray examination apparatus.

Citation of a reference herein, or throughout this specification, is not to construed as an admission that such reference is prior art to the Applicant's invention of the invention subsequently claimed.

SUMMARY OF THE INVENTION

It is an object of the invention to provide an X-ray examination apparatus which includes an exposure control system which is better suitable for adjusting the X-ray examination apparatus on the basis of relevant information in the X-ray image.

This object is achieved by means of an X-ray examination apparatus according to the invention which is characterized in that the exposure control system is arranged to group pixels of the X-ray image in one or more clusters on the basis of their brightness values and to select the relevant part of the X-ray image from the clusters.

A pixel in the X-ray image is assigned to a cluster when a plurality of surrounding pixels have substantially the same brightness value as the relevant pixel. It has been found that for comparatively many radiological examinations that the fact whether or not a cluster contains relevant image information can be determined on the basis of notably the magnitude of the individual clusters. Large clusters often do not contain a large amount of image information. A part of the X-ray image containing relevant image information is thus accurately selected on the basis of the clusters.

The X-ray examination apparatus according to the invention selects relevant parts of the X-ray image automatically and accurately for adjustment of the apparatus on the basis thereof. The control signal for adjusting the X-ray examination apparatus is derived from the selected relevant part. Influencing of the control signal by overexposed or dark parts of the X-ray image is mitigated by selecting a relevant part containing mainly image information. Overexposed and/or dark areas having brightness values far beyond the range containing image information are thus prevented from influencing the adjustment of the image pick-up apparatus. The X-ray examination apparatus can thus be adjusted mainly on the basis of medical diagnostic information contained in the image, so that relevant medical diagnostic details in the X-ray image can be suitably reproduced.

It is to be noted that the grouping of pixels on the basis of their brightness values is known per se from U.S. Pat. No. 5,133,020. In the cited United States patent pixels which likely relate to a part of the X-ray image in which a tumor is reproduced are isolated from the remainder of the X-ray image. This known method is applied to a finished X-ray image and is not used to adjust the X-ray examination apparatus on the basis thereof.

The clusters can be derived directly from the X-ray image by the grouping of pixels of the X-ray image. It is alternatively possible to derive an optical image from the X-ray image by means of the X-ray detector. The clusters can then be formed by the grouping of pixels of the optical image. Both alternatives offer the same result, because the brightness values of the optical image correspond to the brightness values of the X-ray image.

In a preferred embodiment of an X-ray examination apparatus the exposure control system is arranged to derive influence factors of individual clusters from the number of clusters and the size of individual clusters and to adjust the X-ray examination apparatus on the basis of said influence factors. The influence factors of individual clusters represent the influence of the cluster concerned on the control signal, i.e. the extent to which this cluster influences the adjustment provided by the exposure control system. It has been found that notably, when the number of clusters is small, overexposed areas in the X-ray image are situated almost exclusively within said clusters. Furthermore, it has been found that, for example when there are very few clusters, there are often dark areas in the X-ray image in which filter elements and/or collimator elements are reproduced, or that there are hardly any overexposed areas. Furthermore, it has been found that, for example when the number of clusters is not large but not small either, the rather large clusters relate to overexposed areas in the X-ray image.

In a preferred embodiment of an X-ray examination apparatus the exposure control system is arranged to derive the influence factors on the basis of variations of brightness values within individual clusters. It has been found that overexposed areas in the X-ray image have a brightness distribution which is more uniform than that of brighter areas in the image in which relevant image information is contained. By making the influence factors dependent on the variations of brightness values within clusters, it is achieved that the control signal is dependent on whether or not a cluster is rather uniform, i.e. whether or not it probably contains an overexposed area. The effect of overexposed areas on the adjustment of the X-ray apparatus is thus avoided.

In a preferred embodiment of an X-ray examination apparatus is the exposure control system is arranged to compare the size of the clusters with a ceiling value, to derive influence factors on the basis of the number of clusters and differences between the size of individual clusters and the ceiling value and to adjust the ceiling value on the basis of the number of clusters. When there are few clusters, it has been found to be unlikely that they contain overexposed areas. It has been found that it is substantially more likely that there are practically no overexposed areas in such a situation, so that the range of the brightness values in the X-ray image is rather limited. It has been found that for the adjustment of the X-ray examination apparatus by the exposure control system in this situation it is attractive to utilize large clusters for the extraction of the control signal.

In a preferred embodiment of an X-ray examination apparatus the exposure control system is arranged to assign substantially the same influence factor to clusters which adjoin one another in the X-ray image. When the same or approximately the same influence factor is assigned to clusters adjoining one another in the X-ray image, small clusters containing an overexposed area in the X-ray image are prevented from affecting the adjustment of the X-ray examination apparatus. This can be achieved notably by assigning approximately the same influence factors to the small cluster and the large cluster when such a small cluster adjoins a large cluster containing an overexposed area. The effect of notably small overexposed areas near the edge of the X-ray image on the adjustment of the X-ray apparatus is thus counteracted.

In a preferred embodiment of an X-ray examination apparatus the exposure control system is arranged to derive a compressed component from the X-ray image and to form the clusters on the basis of brightness values of the compressed component. The compressed component is derived from the X-ray image by assigning the same brightness values of the compressed component to larger or smaller groups of brightness values of the X-ray image. It is thus achieved that the number of different brightness values in the compressed component is substantially smaller than the number of separate brightness values in the X-ray image. The number of separate brightness values in the compressed component, however, is still large enough to ensure that coarse image information of the X-ray image is preserved in the compressed component. It is thus achieved that not only very small clusters are grouped. Because larger and smaller clusters are derived from the compressed component, overexposed areas and dark areas in the image can be suitably distinguished from relevant image information. Accurate adjustment of the X-ray examination apparatus on the basis of relevant image information in the X-ray image is thus achieved.

In a preferred embodiment of an X-ray examination apparatus the exposure control system is arranged to derive the compressed component from the X-ray image by linear or logarithmic sampling of brightness values of the X-ray image. Only few and simple arithmetic operations are required to reduce the number of brightness values in the X-ray image on the basis of a linear distribution, resulting in a much smaller number of brightness values in the compressed component. By using a logarithmic distribution, the fact that relevant image information is usually represented by low brightness values in the X-ray image is suitably taken into account.

In a preferred embodiment of an X-ray examination apparatus the exposure control system is arranged to derive the influence factors from the number of clusters and the size of the clusters on the basis of fuzzy logic rules. Fuzzy logic is a control technique capable of taking decisions by means of linguistic (if-then) rules. These rules contain knowledge and/or experience gathered by (humans) by using a control system. These knowledge rules can be fed with concrete input variables. The values of the input variables are arranged in given ranges, each of which is designated by a respective label. These labels correspond to the linguistic variables representing the knowledge. Distribution functions are associated with individual labels. Concrete input variables are linked to a given input label on the basis of such distribution functions. From the input label and the knowledge rules there is derived an output label wherefrom a concrete output variable is derived by means of the distribution functions. The use of fuzzy logic for controls in general is known per se from the book "Fuzzy set theory and its applications" by H. J. Zimmerman.

Distribution functions are empirically defined for the number of clusters and the cluster size in order to implement the fuzzy logic rules. It has been found in practice that on the basis of the fuzzy logic rules the X-ray examination apparatus according to the invention is adjusted better than the known apparatus.

In a preferred embodiment, an X-ray examination apparatus comprises an X-ray detector for deriving an optical image from an X-ray image and an exposure control system for adjustment of the X-ray examination apparatus on the basis of a relevant part of the optical image, wherein the exposure control system is arranged to group pixels of the optical image in one or more clusters on the basis of their brightness values and to select the relevant part of the optical image from the clusters. The optical image corresponds to the X-ray image, i.e. the brightness values of the X-ray image correspond to the brightness values of the optical image. Consequently, adjustment of the X-ray examination apparatus on the basis of clusters of pixels relating to relevant image information offers the same results when the clusters are formed from brightness values of the optical image or directly from brightness values of the X-ray image.

The functions of the exposure control system in a contemporary X-ray examination apparatus are preferably executed by means of a suitably programmed computer or a special-purpose (micro)processor.

A further object of the invention is to provide a method of adjusting an x-ray apparatus on the basis of a relevant part of the x-ray image which is better suitable for adjusting the x-ray examination apparatus on the basis of relevant information in the x-ray image. This further object is achieved by a method according to the invention comprising the steps of grouping pixels in the x-ray image in one or more clusters on the basis of their brightness values and selecting said relevant part of the x-ray image from the clusters. These and other aspects of the invention will be described in detail hereinafter on the basis of the following embodiments and with reference to the accompanying drawing, therein:

BRIEF DESCRIPTION OF THE DRAWINGS

The Figure shows diagrammatically an X-ray examination apparatus in which the invention is used.

DETAILED DESCRIPTION OF THE PREFERRED EMBODIMENT

The X-ray examination apparatus includes an X-ray source 10 for irradiating an object 12 to be examined, for example a patient to be radiologically examined, by means of an X-ray beam 11. Due to local differences in the X-ray absorption within the patient, an X-ray image is formed on an X-ray-sensitive surface 13 of the X-ray detector 1. The X-ray detector derives an image signal, e.g. an electronic video signal from the X-ray image. The X-ray detector 1 is an image intensifier pick-up chain which includes an X-ray image intensifier 14 and a television camera 15. The X-ray-sensitive surface is a conversion layer 13 of an entrance screen 16 of the X-ray image intensifier.

The X-rays incident on the entrance screen 16 are converted into blue or ultraviolet light in the conversion layer 13. The entrance screen 16 includes a photocathode 17 which is sensitive to the blue or ultraviolet light of the conversion layer 13. The blue or ultraviolet light of the conversion layer releases an electron beam in the photocathode, said electron beam being guided to a phosphor layer 18 on an exit window 19 by an electron optical system. The electron optical system includes the photocathode 17, alignment electrodes 25 and an anode 26. The electron optical system images the photocathode 17 on the phosphor layer 18 on the exit window 19. The incident electrons produce an optical image of, for example visible or infrared light in the phosphor layer 18. The television camera 15 derives an image signal, notably an electronic video signal, from the optical image. To this end, the television camera 15 is optically coupled to the exit window 19 by means of a lens system 27. The optical image on the exit window is imaged on an image sensor 51, for example a charge coupled (CCD) image sensor, by means of the lens system and the camera lens 50. The lens system 27 collects the light from the exit window 19, forms a substantially parallel light beam 33 and, in conjunction with the camera lens 50, focuses said parallel light beam on the image sensor 51. The image sensor converts the incident light into an electric charge and derives electric voltages from said electric charge. A variable amplifier 52 derives the electronic video signal from said electric voltages. The electronic video signal is applied to a monitor 28 or to a buffer unit 29. The image information contained in the X-ray image is reproduced on the monitor 28. The image signal stored in the buffer unit 29 can be further processed at a later stage.

The X-ray examination apparatus includes an exposure control system 2 with an image detector 30 which picks up the optical image on the exit window. This is realized, for example by guiding a sub-beam 32 from the light beam 33 to the image detector 30 by means of an optical element 31 such as a splitting prism or a partly reflective mirror. The image detector is, for example a charge coupled (CCD) image sensor. For example, 64×64 or 32×32 light-sensitive sensor elements of the CCD image sensor are used to pick up the image on the exit window. The image detector 30 derives an electronic detector signal, representing brightness values in the optical image, from the optical image. The electronic detector signal is read from the image detector by means of a read circuit 34 so as to be digitized. The digital detector signal is applied to a sampling unit 40. The sampling unit 40 performs a linear or a logarithmic sampling operation, separate values being assigned to respective intervals of digital values of the signal level of the digital detector signal (DS). The sampling unit 40 thus derives a digital, sampled detector signal from the digital detector signal. For example, 256 different digital values of the digital detector signal are thus reduced to 32, 16 or 8 different values of signal levels of the sampled signal (SS). The sampled signal actually represents the compressed component of the X-ray image with essentially exclusively low spatial frequencies; this component of the X-ray image mainly contains somewhat coarser details of the image. The sampled signal is used to compose clusters of pixels in the X-ray image by means of a cluster unit 41. Pixels whose associated signal levels of the sampled signal have substantially the same value and adjoin one another in the X-ray image are always assigned to the same cluster. The cluster unit 41 applies information as regards the numbers of clusters, the size (the number of pixels) of clusters, and pixel values of pixels per cluster in the form of digital electronic signals to a data bus 42. Digital information is transported in the exposure control system 2 via the data bus 42. The data transport via the data bus is controlled by a control unit 43.

A counter 44 counts the number of clusters. A measuring device 45 determines the size of individual clusters, i.e. the respective number of pixels present in such a cluster. An arithmetic unit 46 derives a respective influence factor for such a cluster from the size and the dimensions of the clusters. The influence factor represents the degree of influencing of the adjustment of the X-ray examination apparatus by the relevant cluster. Because large clusters usually contain overexposed areas of the X-ray image, or areas in which X-ray absorbing collimator elements and/or filter elements are reproduced, the exposure control system ensures that such large clusters are hardly used for realizing the adjustment. It has been found that when there are less than, for example approximately 70 clusters, the largest clusters, for example those containing more than half the number of pixels in the X-ray image, relate mainly to overexposed areas in the X-ray image. For example, if there are more than 100 clusters, it has been found that the smallest clusters, for example those containing less than approximately 1/10 of the total number of pixels in the X-ray image, relate mainly to overexposed areas in the X-ray image. A device 47 calculates the variation of pixel values within individual clusters. Via the data bus 42, the magnitude of the variations is applied to the arithmetic unit 46 which takes these variations into account in deriving the influence factors. Rather uniform clusters, usually relating to overexposure or collimator elements or filter elements, are thus taken into account less for the adjustment of the X-ray examination apparatus. For example, if the number of pixels of the relevant cluster amounts to 2/3 or more of the number of pixels enclosed by the outer boundary of the relevant cluster, said cluster is so uniform that it simply has to relate to an overexposed area. On the basis of the influence factor for such a uniform cluster it is ensured that such a uniform cluster hardly influences the adjustment of the X-ray examination apparatus. The ceiling value is, for example a fraction of the number of pixels enclosed by the outer boundary of the relevant cluster and lies, for example approximately between 2/3 and 9/10.

The magnitude of respective clusters is compared with a ceiling value by a comparison unit 48. The largest clusters relate to overexposed areas in the X-ray image;

however, if there are only a few clusters, even the larger clusters will not relate to overexposed areas but will contain relevant image information. The ceiling value can be fetched from a memory unit 49. The memory unit 49 is notably constructed as a look-up table (LUT) which contains a respective appropriate ceiling value for different numbers of clusters. A ceiling value which is larger as the number of clusters is smaller is thus used.

A neighbor searcher 59 checks which clusters adjoin one another and the arithmetic unit 46 ensures that approximately the same influence factors are assigned to adjacent clusters.

A fuzzy logic unit 60 derives a camera control signal (CCS) and an X-ray control signal (XCS) on the basis of the cluster size, the number of clusters, the variation of brightness values in clusters, and the influence factors. The fuzzy logic unit 60 applies the camera control signal (CCS) to a control terminal 53 of the amplifier 52 of the television camera. The camera control signal adjusts the amplifier 52 to a suitable gain so as to ensure that relevant image information is clearly reproduced by the electronic video signal, notably that small details of low contrast are reproduced in a suitably visible manner. In particular such a gain is adjusted that underexposure and overexposure of relevant image information are avoided in the rendition of the X-ray image. The fuzzy logic unit 60 applies the X-ray control signal (XCS) to a high-voltage supply 54. The X-ray control signal (XCS) adjusts the intensity and the energy of the X-ray beam 11 in such a manner that relevant image information in the X-ray image is represented by brightness values which can be suitably processed so as to achieve clear reproduction of relevant image information.

All references cited herein are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising:

an X-ray source for forming an X-ray image, an X-ray detector for receiving an X-ray image, and an exposure control system for adjustment of the X-ray examination apparatus, wherein the exposure control system is arrange to group pixels of the received X-ray image in one or more clusters on the basis of each of their brightness values and on the basis of brightness values of the pixels surrounding each pixel, and to adjust the X-ray apparatus on the basis of the numbers of the clusters or the sizes of the individual clusters.

2. An X-ray examination apparatus as claimed in claim 1 wherein the exposure control system is further arranged to derive influence factors of individual clusters from the number of clusters or the size of individual clusters and to adjust the X-ray examination apparatus on the further basis of said influence factors.

3. An X-ray examination apparatus as claimed in claim 2 wherein the exposure control system is further arranged to derive the influence factors on the further basis of variations of brightness values within individual clusters.

4. An X-ray examination apparatus as claimed in claim 2 wherein the exposure control system is further arranged to compare the size of the clusters with a ceiling value, to derive influence factors on the basis of the number of clusters and differences between the size of individual clusters and the ceiling value and to adjust the ceiling value on the further basis of the number of clusters.

5. An X-ray examination apparatus as claimed in claim 2 wherein the exposure control system is further arranged to assign substantially the same influence factor to clusters which adjoin one another in the X-ray image.

6. An X-ray examination apparatus as claimed in claim 1 wherein the exposure control system is further arranged to derive a compressed component from the X-ray image and to form the clusters on the basis of brightness values of the compressed component.

7. An X-ray examination apparatus as claimed in claim 6 wherein the exposure control system is further arranged to derive the compressed component from the X-ray image by linear or logarithmic sampling of brightness values of the X-ray image.

8. An X-ray examination apparatus as claimed in claim 2 wherein the exposure control system is further arranged to derive the influence factors from the number of clusters and the size of the clusters on the basis of fuzzy logic rules.

9. A method of adjusting an x-ray examination apparatus on the basis of an x-ray image comprising:

converting the X-ray image into an optical image, deriving an electronic image signal representing the brightness values in the optical image, grouping pixels in the x-ray image in one or more clusters on the basis of each of their brightness values and on the basis of brightness values of the pixels surrounding each pixel, and adjusting the X-ray apparatus on the basis of the numbers of the clusters or the sizes of the individual clusters.

10. A method of adjusting an x-ray examination apparatus on the basis of an x-ray image comprising:

grouping pixels in the x-ray image in one or more clusters on the basis of each of their brightness values and on the basis of brightness values of the pixels surrounding each pixel, and adjusting the X-ray apparatus on the basis of the numbers of the clusters or the sizes of the individual clusters.

11. An X-ray examination apparatus comprising:

an X-ray source for forming an X-ray image, an X-ray detector for receiving an X-ray image, and an exposure control system for adjustment of the X-ray examination apparatus, wherein the exposure control system is arranged to group pixels of the received X-ray image in one or more clusters on the basis of each of their brightness values and on the basis of brightness values of the pixels surrounding each pixel, to select clusters from the one or more clusters on the basis of the sizes of the individual clusters, and to adjust the X-ray apparatus on the basis of the pixels in the selected clusters.

12. An X-ray examination apparatus comprising;

an X-ray source for forming an X-ray image, an X-ray detector for receiving an X-ray image, wherein the X-ray detector further comprises means for converting the X-ray image into an optical image, and means for deriving an electronic image signal representing the brightness values in the optical image, and an exposure control system for adjustment of the X-ray examination apparatus, wherein the exposure control system is arranged to group pixels of the received X-ray image in one or more clusters on the basis of each of their brightness values and on the basis of brightness values of the pixels surrounding each pixel, to select clusters from the one or more clusters on the basis of the sizes of the individual clusters, and to adjust the X-ray apparatus on the basis of the pixels in the selected clusters.

13. The method of claim 10 further comprising the step of deriving a compressed component from the X-ray image, and wherein the step of grouping forms the clusters on the basis of brightness values of the compressed component.

14. The apparatus of claim 11 wherein the exposure control system is further arranged to derive a compressed component from the X-ray image, and to form the clusters on the basis of brightness values of the compressed component.

15. An X-ray examination apparatus comprising;

an X-ray source for forming an X-ray image, an X-ray detector for receiving an X-ray image, wherein the X-ray detector further comprises means for converting the X-ray image into an optical image, and means for deriving an electronic image signal representing the brightness values in the optical image, and an exposure control system for adjustment of the X-ray examination apparatus, wherein the exposure control system is arranged to group pixels of the received X-ray image in one or more clusters on the basis of each of their brightness values and on the basis of brightness values of the pixels surrounding each pixel, and to adjust the X-ray apparatus on the basis of the numbers of the clusters or the sizes of the individual clusters.

* * * * *